US006150080A

United States Patent [19]

Ando

[11] Patent Number: 6,150,080

[45] Date of Patent: Nov. 21, 2000

[54] SILVER HALIDE EMULSION AND SILVER HALIDE PHOTOGRAPHIC LIGHT SENSITIVE MATERIAL

[75] Inventor: Hiroaki Ando, Hino, Japan

[73] Assignee: Konica Corporation, Japan

[21] Appl. No.: 09/390,423

[22] Filed: Sep. 3, 1999

[30] Foreign Application Priority Data

Sep. 9, 1998 [JP] Japan ..... 10-255065

[51] Int. Cl.[7] ..... G03C 1/035

[52] U.S. Cl. ..... 430/567

[58] Field of Search ..... 430/567

[56] References Cited

U.S. PATENT DOCUMENTS 5,492,801 2/1996 Maskasky ..... 430/567
5,702,878 12/1997 Maruyama ..... 430/567
5,965,344 10/1999 Ando et al. ..... 430/567

FOREIGN PATENT DOCUMENTS 0460656 11/1991 European Pat. Off. .

*Primary Examiner*—Hoa Van Le
*Attorney, Agent, or Firm*—Jordan B. Bierman; Bierman, Muserlian and Lucas

[57] ABSTRACT

A silver halide emulsion is disclosed, comprising tabular silver halide grains, wherein the tabular grains contain 50 mol % or more bromide, based on total silver and have parallel (111) major faces and a mean aspect ratio of not less than 2; and the tabular grains each comprising a central region accounting for at least 50% of the (111) major face, and an annular band accounting for not more than 5% of the (111) major face and containing not less than 0.05 mol % iodide and not more than 50 mol % chloride, based on silver forming the annular band.

9 Claims, 1 Drawing Sheet

SILVER HALIDE EMULSION AND SILVER HALIDE PHOTOGRAPHIC LIGHT SENSITIVE MATERIAL

FIELD OF THE INVENTION

The present invention relates to photographic silver halide emulsions, silver halide photographic light sensitive materials, and in particular to silver halide emulsions containing tabular grains and photographic materials having enhanced sensitivity and superior storage stability.

BACKGROUND OF THE INVENTION

In camera speed silver halide photographic materials is conventionally employed silver iodobromide in terms of the ratio of sensitivity to glanularity. Recently, in response to requirements for enhanced high-speed processing in the photographic field, it has been desired to reduce the iodide contained in silver halides which exhibit the characteristic of retarded development. In photographic print materials, on the other hand, silver chloride emulsions have been employed. As is well known, silver chloride has the characteristic for promoting development, but it has not been suitable in terms of the ratio of sensitivity to glanularity.

JP-A 10-123641 (herein, the term, JP-A means an unexamined and published Japanese Patent Application) discloses (111) tabular grains mainly comprised of silver iodobromide and including dislocation lines, which further comprises a silver chloride shell. Thus, although it is disclosed that silver chloride is indispensably incorporated for the purpose of covering the whole grain, nothing is taught therein with respect to forming an annular band. Further, nor is anything disclosed with respect to the necessity of containing iodide. JP-A 5-53232 discloses a technique of providing a new function by converting a chloride containing portion to a different silver halide. However, there is not taught anything with respect to the merit of converting at least a part of the chloride to iodide in the annular band formed in (1119 tabular grains. JP-A 8-254779 and 8-254780 disclose a technique of forming high chloride annular band in the tabular grains. Again, nothing is taught therein with respect to the advantage of allowing iodide to be contained in the annular band portion.

SUMMARY OF THE INVENTION

Accordingly, it is an object of the present invention to provide silver halide emulsions having enhanced sensitivity and superior storage stability and silver halide photographic light sensitive materials by use thereof.

The object of the invention can be accomplished by the following constitution:

1. a silver halide emulsion comprising tabular silver halide grains, wherein said tabular grains contain 50 mol % or more bromide, based on total silver and have parallel (111) major faces and a mean aspect ratio of not less than 2; and the tabular grains each comprising a central region accounting for at least 50% of the (111) major face, and an annular band accounting for not more than 5% of the (111) major face and containing not less than 0.05 mol % iodide and not more than 50 mol % chloride, based on silver forming the annular band; and 2. a method of preparing a silver halide emulsion comprising tabular grains, wherein said tabular grains contain 50 mol % or more bromide, based on total silver and have parallel (111) major faces and a mean aspect ratio of not less than 2; and the tabular grains each comprising a central region accounting for at least 50% of the (111) major face, and an annular band accounting for not more than 5% of the (111) major face and containing not less than 0.05 mol % iodide and not more than 50 mol % chloride, based on silver forming the annular band, the method comprising the steps of:

(a) reacting silver and a halide salts in solution to form tabular grains substantially not containing chloride, (b) reacting a silver salt solution and a chloride containing halide salt solution to form the annular band containing chloride and (c) adding a water soluble iodide salt to perform conversion of at least a part of the chloride to iodide.

DETAILED DESCRIPTION OF THE INVENTION

Figure 1A:
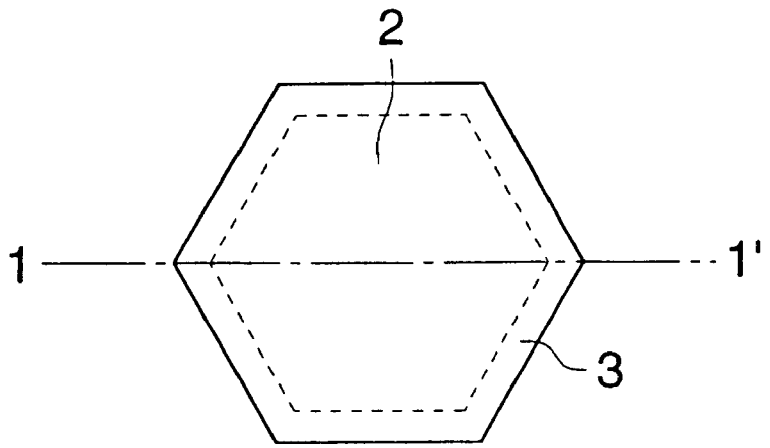
FIG. 1*a* shows a plan view of the tabular grain, indicating the central region 2 and the annular band 3.

According to the present invention, retardation in development due to iodides can be avoided by maintaining a relatively low iodide content on the major faces and stability can also be kept by allowing iodide to be contained in the annular band. Development is further promoted by allowing chloride to be contained in the annular band, without adversely affecting adsorption of a sensitizing dye onto the major faces.

The present invention will be further described in detail. The silver halide emulsion according to the invention comprises tabular grain having parallel (111) major faces. The tabular grains preferably exhibit an aspect ratio of not more than 2 and contain at least 50 mol % bromide. The tabular grains are each comprised of parallel, (111) major faces and side faces connecting the major faces. At least one twin plane is present between the major faces and conventionally, two twin planes are observed. The spacing between the two twin planes can be reduced to less than 0.012 $\mu$m, as described in U.S. Pat. No. 5,219,720, and the value of the spacing between the (111) major faces divided by the spacing between the twin planes, as described in JP-A 5-249585.

In the emulsion, tabular grains having an aspect ratio of 2 or more preferably account for at least 30% of the total grain projected area. The grain projected area and aspect ratio of the tabular grains can be determined from shadowed electronmicrographs obtained by the carbon replica method using latex balls as reference. When viewed from the top, the tabular grains conventionally exhibit hexagonal, triangular or spherical shape. The aspect ratio is the value of an equivalent circular diameter (i.e., a diameter of a circle having an area identical to the projected area) divided by the thickness of the grain. The tabular grains preferably have a hexagonal form, in which the adjacent edge ratio of the hexagonal grains is preferably 1:2 or less (in other words, the maximum adjacent edge ratio is 2). The desired effects of the invention can be achieved by tabular grain having an aspect ratio of 2 or more, irrespective of its value. At least 30% of the total grain projected area of the tabular grain emulsion is preferably accounted for by tabular grains having an aspect ratio of not less than 2, and more preferably 2 to 20. When the aspect ratio is too large, a coefficient of variation of grain size frequency distribution tends to be increased. The coefficient of variation of grain size frequency distribution is preferably not more than 20%, and more preferably not more than 15%.

The emulsion according to the invention comprises silver iodochlorobromide grains. The tabular grains according to the invention each are comprised of regions different in the halide composition, in which one of the regions is a central region, and a second region is an annular band. The central region of the tabular grain preferably contains not more than 15 mol % iodide and more preferably not more than 10 mol % iodide. The annular band portion of the grain preferably contains not more than 50 mol % (and more preferably from 0.1 to 50 mol %) chloride, and preferably containing not less than 0.05 mol % iodide. A coefficient of variation of the chloride content distribution among grains is preferably not more than 20%, and more preferably not more than 10%.

The central region is preferably in a hexagonal form within the major face of the tabular grain, in which the hexagonal form is the same as defined in the hexagonal tabular grains. The annular band is preferably an outer region adjacent to the hexagonal central region. In other words, the central region and the annular band each extend between and form a portion of the (111) major faces. The center of gravity of the hexagonal tabular grain is usually the same as that of the central region of the hexagonal tabular grain, but both centers of gravity may deviate from each other when forming the annular region. For example, the growth behavior of hexagonal tabular grains is reported in the Journal of Imaging Science 31 15 (1987), in which Photograph 9 illustrates deviation of the center of gravity.

The central region and the annular band portion, each forms a portion of the (111) major faces. The central region accounts preferably not less than 50% of the (111) major face; and the annular band accounts preferably not more than 5% of the (111) major faces, and more preferably not less than 0.5% and not more than 5% of the (111) major faces. The central region and the annular band each extend between and form a portion of the (111) major faces.

Figure 1B:
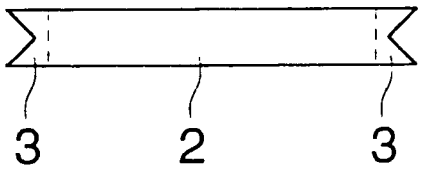
FIGS. 1*b* and 1*c* each show a sectional view of the section 1-1'.
Figure 1C:
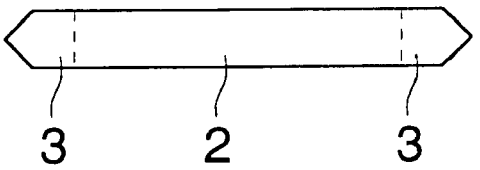

FIGS. 1*a* to 1*c* illustrate the tabular grain according to the invention. FIG. 1*a* shows a plan view of the tabular grain, indicating the central region 2 and the annular band 3. FIGS. 1*b* and 1*c* each show a sectional view of the section 1-1'. Specifically, FIG. 1*b* shows an annular band which inwardly extends and FIG. 1*c* shows an annular band which outwardly extends.

The tabular grains having the central region preferably contain dislocation lines. The location of the dislocation lines is not specifically limited but the dislocation lines are preferably located in the central region. It is also preferred that the dislocation lines be located in both the central region and the annular band. With respect to the number of the dislocation lines, tabular grain containing 5 or more dislocation lines preferably account for at least 30% of the total projected area of grains contained in the emulsion. The number of the dislocation lines is more preferably 10 or more per grain. In cases where the dislocation lines are located in the interior and the fringe portion of the grain, it is preferred that 5 or more dislocation lines be present in the interior, and more preferably, 5 or more dislocation lines are present in both the interior and the fringe portion.

The method for introducing the dislocation lines into the silver halide grain is not specifically limited. The dislocation lines can be introduced by employing various methods, in which, at a desired position of introducing the dislocation lines during the course of forming silver halide grains, an iodide (e.g., potassium iodide) aqueous solution is added, along with a silver salt (e.g., silver nitrate) solution and without addition of a halide other than iodide by a double jet technique, silver iodide fine grains are added, only an iodide solution is added, or a compound capable of releasing an iodide ion disclosed in JP-A 6-11781 (1994) is employed. Of these methods are preferred the method of adding the iodide aqueous solution and silver salt aqueous solution by the double jet technique, the method of adding fine silver iodide grains and the method of adding the iodide releasing compound. The iodide aqueous solution is preferably an alkali iodide aqueous solution, and the silver salt aqueous solution is a silver nitrate aqueous solution.

The dislocation lines of silver halide grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while making sure not to exert any pressure that may cause dislocation in the grains, and the grains are then placed on a mesh for electron microscopy. The sample is observed by transmission electron microscopy, while being cooled to prevent the grain from being damaged by electron beam (e.g., printing-out). Since electron beam penetration is hampered as the grain thickness increases, sharper observations are obtained by using a higher voltage type electron microscope (e.g., 200 kV or higher for grains having a thickness of 0.25 $\mu$m). From the thus-obtained electron micrograph can be determined the position and number of the dislocation lines in each grain.

Silver halide tabular grain emulsions according to the invention can be prepared by various methods known in the art. In preferred embodiment of the invention, the emulsion can be prepared by a process comprising (i) reacting silver and a halide salts in solution to form tabular grains substantially not containing chloride, (ii) reacting a silver salt solution and a chloride containing halide salt solution to form the annular band containing chloride and (iii) adding a water soluble iodide salt to perform conversion of at least a part of the chloride to iodide.

In the step (i) described above, the tabular grains substantially not containing chloride are preferably those which contain not more than 5 mol % chloride, more preferably not more than 1 mol % chloride, and still more preferably not more than 0.3 mol % chloride.

The annular band containing chloride will now be further described. JP-A 9-319017 discloses that the chloride content in the vicinity of corners which is higher than the mean overall chloride content of grains, resulted in development promoting effects and also discloses a technique for forming such grains by partially dissolving tabular grains to allow the chloride to be included in the corners. However, it was proved that when grains containing dislocation lines were subjected to such a treatment, the dislocation lines of lattice defects were destroyed, and it often became difficult to achieve development promoting effects of silver chloride, while keeping superior photographic performance. In contrast, forming a chloride containing portion in the annular band without dissolving the grains made it easier to maintain the dislocation lines, enabling easy conversion of the chloride to the iodide.

In the invention, after forming the chloride containing band, it is preferred to convert a part or the whole of the chloride to iodide by adding an iodide ion such as potassium iodide. The iodide ion releasing compounds described above may also be included. Although the chloride containing portion effectively promotes development, higher solubility of the chloride possibly causes a drop in the stability of performance. Conversion of a part of the chloride to iodide results in stabilized performance, while maintaining the advantageous effects of the chloride. If conversion to iodide is conducted before formation of the chloride containing band, only bromide is converted to iodide, making it difficult to stabilize the chloride containing band and in addition, it is hard to form a iodide containing portion within the band. Coexistence of an iodide ion or silver iodide at the time of forming the chloride containing band can form an annular band containing both chloride and iodide. In such case, supplying a silver ion causes preferentially deposition of silver iodide so that the halide composition in the vicinity of the surface tends to be riche in chloride. Therefore, to allow iodide to be preferentially contained in the vicinity of the surface to stabilize performance is preferred halide conversion by using iodide ions.

The annular band containing chloride is preferred for promoting development and the central region may also contain chloride. The chloride content of the annular band may be higher or lower than that of the central region.

The iodide ion may be added before sensitization or after adding a part or all of a chemical sensitizer or a spectral sensitizing dye. Addition of an iodide ion affects adsorption of a sensitizing dye. Thus, effects of the iodide ion on adsorption of a sensitizing dye are generally different between before or after adding the sensitizing dye so that the adding sequence may appropriately be selected so as to obtain the preferred photographic performance. The iodide also affects sulfur sensitization or selenium sensitization so that addition of the iodide may be conducted in the appropriate order to achieve preferred photographic performance.

The chloride content in the annular band can be determined using a transmission electronmicroscope provided with an elementary analysis device, at a low temperature. The iodide content in the central region can be determined similarly, or also by X-ray diffractometry.

Silver halide emulsions according to the invention can be prepared with reference to Cleave, "Photography Theory and Practice" (1930) page 131; Gutoff, Phot. Sci. Eng. 14 248–257 (1970); U.S. Pat. Nos. 4,434,226, 4,414,310, 4,433,048 and 4,439,520; British Patent 2,112,157.

Preparation of host grains is basically comprised of a combination of nucleation, ripening and growth. The methods described in U.S. Pat. No. 4,797,354 and JP-A 2-838 are effective for preparing host grains used in the invention.

The use of gelatin having a low methionine content in nucleation, as described in U.S. Pat. Nos. 4,713,320 and 4,942,120; nucleation at a high pBr, as described in U.S. Pat. No. 4,914,014 and nucleation conducted over a short period of time, as described in JP-A 2-222,940 are effective in the nucleation stage of core grains used in the invention. Techniques of ripening at a low base concentration, as described in U.S. Pat. No. 5,254,453 and at a high pH, as described in U.S. Pat. No. 5,013,641 are effective for ripening tabular host grain emulsions used in the invention. The preparation of tabular grains by the use of polyalkyleneoxide compounds, as described in U.S. Pat. Nos. 5,147,771, 5,147,772, 5,147,773, 5,171,659 and 5,210,013 is preferably employed in preparing host grains used in the invention.

An iodide containing annular band portion is allowed to grow on the tabular grains according to the method described above. The temperature, the pH, the kind of protective colloid such as gelatin or its concentration, and a silver halide solvent including kind and concentration can be broadly varied. The pCl in growing a chloride containing annular band portion, prior to forming the iodide containing annular band portion is preferably 3 or less, and more preferably 2 or less. In this case, the pCl means a logarithm of reciprocal of the chloride ion concentration, assuming that the whole of bromide ions react with silver ions and any remaining silver ions react with chloride ions. Instead of the double jet addition of an aqueous silver nitrate solution and an aqueous halide salt solution, an aqueous silver nitrate solution, an aqueous chloride and bromide solution and a fine silver iodide grain emulsion may concurrently be added. The first shell can be formed by adding a fine silver iodobromide grain emulsion to perform ripening.

Gelatin is advantageously employed as a protective colloid utilized in preparation of emulsions used in the invention or as a binder of a hydrophilic colloidal layer. Other hydrophilic colloids can also be employed. Examples thereof include gelatin derivatives; graft polymers of gelatin with other polymers, proteins such as albumin and casein; cellulose derivatives such as hydroxyethyl cellulose, carboxymethyl cellulose and cellulose sulfuric acid ester; saccharide derivatives such as sodium alginate and starch derivatives; and synthetic hydrophilic polymer materials such as polyvinyl alcohol, partial acetal of polyvinyl alcohol, poly-N-vinyl pyrrolidone, polyacrylic acid, polymethacrylic acid, polyacrylamide, polyvinyl imidazole, polyvinyl pyrazole, and their copolymers.

Examples of gelatin include alkali process gelatin, acid process gelatin, enzymatic process gelatin described in Bull. Soc. Sci. Photo. Japan No. 16, page 30 (1966) and hydrolyzed gelatin.

Silver halide emulsions used in the invention may be washed for desalting and redispersed in a newly prepared protective colloid. The washing temperature is optional and preferably 5 to 50° C. The washing pH is optional and preferably 2 to 10, and more preferably 3 to 8. The washing pAg is preferably 5 to 10. Examples of the washing method include noodle washing, dialysis by using a semi-permeable membrane, centrifugation, coagulation process and deionization. The coagulation process includes coagulation by use of sulfates, organic solvents, water-soluble polymers or gelatin derivatives.

In the course of preparing silver halide emulsions used in the invention, salts of metal ions are optionally allowed to coexist during grain formation, at the stage of desalting, during chemical sensitization or before coating. It is preferred that in cases of doping into the grain, metal salts are added during grain formation; and in cases of being used for modifying the grain surface or as a chemical sensitizer, the metal salts are added after grain formation but before completing chemical ripening. Metals may be doped into the overall grain, only in the core portion or only in the shell portion. Examples of metals to be doped include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. These metals can be added in the form of a water-soluble salt, such as ammonium salt, acetate salt, nitrate salt, sulfate salt, phosphate salt, hydroxy salt, or hexa-coordinated or tetra-coordinated complex salt. Examples thereof include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. Ligands of the complex include halo, aquo, cyano, cyanate, thiocyanate, nitrocyl, thionitrocyl, oxo, and carbonyl. The metal salts may be employed alone or in combination of two or more kinds of the metal salts.

The metal salts can be added through solution in water or organic solvents such as methanol and acetone. A hydrogen halide (e.g., HCl, HBr, etc.) solution or alkali halide (e.g., KCl, NaCl, KBr, NaBr, etc.) may further be added to enhance stability of solutions. Acids or bases may optionally be added. The metal salts may be added before or during grain formation. The metal salts can continuously be added, during grain formation, by adding the salts to a water-soluble silver salt aqueous solution (e.g., $AgNO_3$) or water-soluble halide aqueous solution (e.g., NaCl, KBr, KI, etc.). Alternatively, a metal salt solution may separately be added. Addition can be conducted by the combined use of the methods described above.

There may be added, during grain formation, a chalcogenide compound described in U.S. Pat. No. 3,772,031. Cyanates, thiocyanates, selenocyanates, carbonates, phosphates or acetates may be allowed to be present besides sulfur, selenium and tellurium compounds.

Silver halide grains used in the invention can be subjected to at least one of sulfur sensitization, selenium sensitization, gold sensitization, palladium sensitization or other noble metal sensitization, or reduction sensitization at any stage during the course of preparing silver halide emulsions. A combination of two or more sensitizations is preferred. Various types of emulsions can be prepared by selecting the stage to be subjected to chemical sensitization, including a type of occluding chemical sensitization sites in the interior of the grain, a type of occluding the sites in a shallow position from the grain surface and a type of forming the sites on the grain surface. The position of chemical sensitization sites can optionally be selected, and it is generally preferred to form chemical sensitization sites in the vicinity of the grain surface.

Preferred chemical sensitization used in the invention includes chalcogenide sensitization and noble metal sensitization, alone or in combination. The chemical sensitization can be conducted using an active gelatin described in T. H. James, The Theory of the Photographic Process, 4th ed., Macmillan (1977), page 67–76; or at a pAg of 5 to 10, a pH of 5 to 8 and a temperature of 30 to 80° C. using any combination of sulfur, selenium, gold, platinum, palladium and iridium sensitizers, as described in Research Disclosure vol. 120, April 1974, 12008, Research Disclosure vol. 134, June, 1975, 13452, U.S. Pat. Nos. 2,642,361, 3,297,446, 3,772,031, 3,857,711, 3,901,714, 4,266,018 and 3,904,415 and British Patent 1,315,755. In the noble metal sensitization are employed noble metal salts of gold, platinum, palladium, iridium and the like. Of these, gold sensitization, palladium sensitization and their combination are preferably employed. In the gold sensitization can be employed known compounds such as chloroauric acid, potassium chloroaurate, potassium aurithiocyanate, gold sulfide and gold selenide. Palladium sensitizers include compounds or salts of palladium metal with a valence of 2 or 4.

Sulfur sensitizers include hypo (or thiosulfates)thiourea compounds, rhodanine compounds and sulfur containing compounds described in U.S. Pat. Nos. 3,857,711, 4,266,018 and 4,054,457. Chemical sensitization can be carried out in the presence of chemical sensitization aids. As useful chemical sensitization aids, compounds capable of restraining fogging during chemical sensitization and enhancing sensitivity are known, including azaindenes, azapyridazines and azapyrimidine. Examples thereof are described in U.S. Pat. Nos. 2,131,038, 3,411,914 and 3,554,757; JP-A 58-126526; and Duffin, Photographic Emulsion Chemistry, page 138–143.

It is preferred to simultaneously employ gold sensitization in the silver halide emulsions used in the invention. A gold sensitizer is preferably used in an amount of $1\times10^{-7}$ to $1\times10^{-4}$ mol, more preferably $1\times10^{-7}$ to $1\times10^{-5}$ mol per mol of silver halide. Thiocyanates or selenocyanates may preferably be used in an amount of $1\times10^{-6}$ to $5\times10^{-4}$ mol per mol of silver halide. Sulfur sensitizers are preferably used in an amount of $1\times10^{-7}$ to $1\times10^{-4}$ mol, and more preferably $5\times10^{-7}$ to $1\times10^{-5}$ mol per mol of silver halide.

Selenium sensitization is also preferably employed in the silver halide emulsions used in the invention. In the selenium sensitization are used unstable selenium compounds known in the art, including colloidal metallic selenium, selenoureas (e.g., N,N-dimethylselenourea, N,N-diethylselenourea, etc.), selenoketones and selenoamides. Selenium sensitization is preferably employed in combination with sulfur sensitization or noble metal sensitization, alone or in combination.

The silver halide emulsions used in the invention are preferably subjected to reduction sensitization during grain formation, after grain formation and before or during chemical sensitization, or after chemical sensitization. Reduction sensitization can be performed by any one of a method in which reduction sensitizers are added, so-called silver ripening in which silver halide grains are grown or ripened in an environment at a pAg of 1 to 7, and high pH ripening in which grain growth or ripening is performed in an environment at a pH of 8 to 11. These methods may be employed in combination.

Of the reduction sensitization methods described above, the addition of reduction sensitizers is preferred in terms of capability of adjusting the levels of reduction sensitization. The reduction sensitizers include known compounds such as stannous salts, ascorbic acid and its derivatives, amines and polyamines, hydrazine derivatives, formamidinesulfinic acid, silanes and boranes. The reduction sensitizers may be used alone or in combination. Specifically, of these reduction sensitizers are preferred stannous chloride, thiourea dioxide, dimethylamine borane, and ascorbic acid including its derivatives, alkynylamine compounds, described in U.S. Pat. No. 5,389,510 are also effective compounds. The addition amount of the reduction sensitizer, depending of emulsion making conditions, is preferably $10^{-7}$ to $10^{-3}$ mol per mol of silver halide. The reduction sensitizer can be added through solution in water or organic solvents such as alcohols, glycols, ketones, esters and amides, during the grain growth. The reduction sensitizer may be added to a reaction vessel in advance, and it is preferably added at a time during the grain growth. Adding the reduction sensitizer to a water-soluble silver salt or alkali halide solution in advance and using this solution, precipitation of silver halide grains can be performed. The reduction sensitizer can dividedly or continuously be added over a period of time.

Oxidizing agents are preferably used in the stage of preparing silver halide emulsions used in the invention. The oxidizing agents usable in the invention refer to compounds having function of transforming metallic silver to a silver ion. Specifically, effective compounds are those capable of transforming fine silver grains produced during the course of forming silver halide grains or chemical sensitization thereof, to silver ions. The produced silver ions may form sparing water-soluble silver salts such as silver halide, silver sulfide and silver selenide, or water-soluble salts such as silver nitrate. Examples of inorganic oxidizing agents include ozone, hydrogen peroxide and its adducts, oxyacid salts such as peroxyacid salts, peroxy-complexes, permanganates and chromates, halogens such as iodine and bromine, perhalogenates, metals of high valence and thiosulfonic acid. Examples of organic oxidizing agents include quinones such as p-quinone, organic peroxide such as peracetic acid and perbenzoic acid and compounds capable of releasing an active halogen (e.g., N-bromsucciimide, chloramine T, chloramine B). Of these, inorganic oxidizing agents of ozone, hydrogen peroxide and its adducts, halogens and thiosulfonates and organic oxidizing agents of quinones. Disulfide compounds are also preferred, as described in European Patent 0627657A2. The combined use of the above-described reduction sensitization and the above-described oxidizing agent is one preferred embodiment of the invention, which is optimally conducted in such a way of using an oxidizing agent, followed by reduction sensitization; its reverse manner or allowing both to simultaneously coexist. These may be conducted during the grain formation or chemical sensitization.

A variety of compounds can be employed in the emulsion used in the invention to prevent fogging or stabilize photographic performance during the preparation of a photographic material or its storage. Examples thereof include thiazoles such as benzthiazoles, nitroimidazoles, nitrobenzimidazoles, chlorobenzimidazoles, bromobenzimidazoles, mercaptothiazoles, mercaptobenzimidazoles, mercaptothiadiazoles, aminotriazoles, benztriazoles, nitrobenztriazoles, mercaptotetrazoles (specifically, 1-phenyl-5-mercaptotetrazole); mercaptopyrimidines; mercaptotriazines; thioketo compounds such as oxazolinethione; azaindenes such as triazaindenes, tetrazaindenes [specifically, 4-hydroxy-substituted-1,3,3α,7-tetrazaindenes] and pentazaindenes. These compounds have been known as an antifoggants or stabilizer, as described in U.S. Pat. Nos. 3,945,474 and 3,982,947 and JP-B 52-28660 (herein, the term, JP-B means published Japanese Patent). Preferred compounds are those described in JP-A 63-212932. Antifoggants or stabilizers can be incorporated at any time of before, during or after the grain formation; the washing stage or redispersing stage after washing; before, during or after chemical sensitization; and before coating. Some of these compounds can be used for the purpose of controlling crystal habit, restraining grain growth, lowering solubility of grains, controlling chemical ripening and controlling aggregation of sensitizing dyes other than antifogging or stabilizing action.

The silver halide emulsion may be spectrally sensitized to an optional spectral wavelength with a sensitizing dye. Useful sensitizing dye includes, for example, cyanine dyes, merocyanine dyes, complex cyanine dyes, complex merocyanine dyes, holopolar cyanine dyes, hemicyanine dyes, styryl dyes, and hemioxonol dyes. To these dyes, any nucleus applied to the cyanine dyes may be applied as a basic heterocyclic nucleus. That is to say, pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, etc.; and those nuclei fused with an alicyclic hydrocarbon ring or an aromatic hydrocarbon ring, i.e., indolenin nucleus, benzindolenin nucleus, indole nucleus, benzoxazole nucleus, naphthoxazole nucleus, benzthiazole nucleus, naphthothiazole nucleus, benzselenazole nucleus, benzimidazole nucleus, quinoline nucleus, etc. may be applied. These nuclei may be substituted on a carbon atom thereof. To merocyanine dyes or complex merocyanine dyes, as a nucleus having a ketomethylene structure, five-membered or six-membered heterocycle, such as thiohydantoin nucleus, 2-thiooxazolidine-2,4-di-one nucleus, rhodanine nucleus, thiobarbituric acid nucleus, etc. can be applied.

These sensitizing dyes can be used alone or in combination. The combined use of the sensitizing dyes are often employed for the purpose of super-sensitization. Exemplary examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707; British Patent 1,344,281 and 1,507,803, JP-B 43-4936 and 53-12375: JP-A 52-110618 and 52-109925.

Together with the sensitizing dye, there may be incorporated into the emulsion, a dye having no sensitizing action or a substance absorbing no visible light, each of which exhibits super sensitization. The sensitizing dyes can be added at any time during the course of the preparation of emulsions. Although the sensitizing dye is usually added after completing chemical sensitization and before coating, it can be conducted in such a way that the sensitizing dye is added together with a chemical sensitizer to simultaneously achieve spectral sensitization and chemical sensitization, as described in U.S. Pat. Nos. 3,628,969 and 4,225,666; the sensitizing dye is added prior to chemical sensitization; the sensitizing dye is added before completing the precipitation of silver halide grains to initiate spectral sensitization. Further, the sensitizing dye can dividedly be added, as described in U.S. Pat. No. 4,225,666; exemplarily, a part of the sensitizing dye is added prior to chemical sensitization and the remainder is added after completing chemical sensitization. Furthermore, the sensitizing dye can be added during the formation of silver halide grains, as described in U.S. Pat. No. 4,183,756. The sensitizing dye is incorporated preferably in an amount of $4\times10^{-6}$ to $8\times10^{-3}$ mol per mol of silver halide, and specifically, in cased of the grain size of 0.2 to 1.2 $\mu$m, the amount of $5\times10^{-5}$ to $2\times10^{-3}$ mol per mol of silver halide.

To a silver halide emulsions are further incorporated a variety of adjuvants in response to various objectives. Examples thereof are described in RD-17643 (December, 1978), RD-18716 (November, 1979) and RD-308119 (December, 1989), as shown below.

| Additive | RD-17643 | RD-18716 | RD-308119 |
|---|---|---|---|
| 1. Chemical sensitizer | 23 | 648 right | 996 |
| 2. Speed enhancing agent | | 648 right | |
| 3. Spectral sensitizer/ Supersensitizer | 23–24 | 648 right–649 right | 996–998 |
| 4. Brightening agent | 24 | | 998 right |
| 5. Antifoggant/stabilizer | 24–25 | 649 right | 998 right–1000 right |
| 6. Light absorbent/ Filter dye/UV absorbent | 25–26 | 649 right–650 left | 1003 left–1003 right |
| 7. Antistaining agent | 25 right | 650 left–right | 1002 right |
| 8. Image stabilizer | 25 | | 1002 right |
| 9. Hardener | 26 | 651 left | 1004 right–1005 left |
| 10. Binder | 26 | 651 left | 1003 right–1004 right |
| 11. Plasticizer/Lubricant | 27 | 650 right | 1006 left–1006 right |
| 12. Coating aid/Surfactant | 26–27 | 650 right | 1005 left–1006 left |
| 13. Antistatic agent | 27 | 650 right | 1006 right–1007 left |
| 14. Matting agent | | | 1008 left–1009 left |

Layer arrangement techniques, silver halide emulsions, dye forming couplers, functional couplers and various additives applicable to silver halide emulsions used in the invention and photographic materials by use thereof are described in European Patent 0565096A1 (published in Oct. 13, 1993) and references cited therein, as shown below:

1. Layer arrangement: page 61, line 23–35; page 61, line 41 to page 62 line 14;
2. Interlayer: page 61, line 36–40;
3. Interlayer effect providing layer: page 62, line 15–18;
4. Silver halide composition: page 62, line 21–25;
5. Silver halide crystal habit: page 62, line 26–30;
6. Silver halide grain size: page 62, line 31–34;
7. Silver halide emulsion preparation: page 62, line 35–40;
8. Silver halide grain size distribution: page 62, line 41–42;
9. Tabular grain: page 62, line 43–46;
10. Internal grain structure: page 62, line 47–53;
11. Type of latent image formation of emulsion: page 62, line 54 page 63, line 5;
12. Physical and chemical ripening: page 63, line 6–9;
13. Emulsion blending: page 63, line 10–13;
14. Fogged emulsion: page 63, line 14–31;
15. Light-insensitive emulsion: page 63, line 32–43;
16. Silver coating weight: page 63, line 49–50;
17. Photographic additives: Research Disclosures described above
18. Formaldehyde scavenger: page 64, page 54–57;
19. Mercapto type antifoggant: page 65, line 1–2;
20. Foggant-releasing agent: page 65, line 3–7;
21. Dye: page 65, line 7–10;
22. Coupler (general): page 65, line 11–13;
23. Yellow, magenta and cyan coupler: page 65, line 14–25;
24. Polymer coupler: page 65, line 26–28;
25. Antidiffusible coupler: page 65, line 29–31;
26. Colored coupler: page 65, line 32–38;
27. Functional coupler (general): page 65, line 39–44;
28. Bleach accelerator releasing coupler: page 65, line 45–48;
29. Development accelerator releasing coupler: page 65, line 49–53;
30. Other DIR coupler: page 65, line 54 to page 66, line 4;
31. Coupler dispersion: page 66, line 5–28;
32. Antiseptic and antifungal agents: page 66, line 29–33;
33. Kind of photographic material: page 66, line 34–36;
34. Light sensitive layer thickness and swelling speed: page 66, line 40 to page 67, line 1;
35. Backing layer: page 67, line 3–8;
36. Development (general): page 67, line 9–11;
37. Developer, developing agent: page 67, line 12–30;
38. Developer additive: page 67, line 31–44;
39. Reversal development: page 67, line 45–56;
40. Open top area: page 67, line 57 to page 68, line 12;
41. Developing time: page 68, line 13–15;
42. Bleach-fixing, bleaching, fixing: page 68, line 16 to page 69, line 31;
43. Automatic processor: page 69, line 32–40;
44. Wash, rinse, stabilization: page 69, line 41 to page 70, line 18;
45. Replenishment, reuse: page 70, line 19–23;
46. Developer-incorporated material: page 70, line 24–33;
47. Developing temperature: page 70, line 34–38;
48. Lens-fitted film: page 70, line 39–41.

There can preferably be employed bleaching solutions containing 2-pyridine-carboxylic acid or 2,6-pyridine-dicarboxylic acid, a ferric salt such as ferric nitrate, and persulfate salt, as described in European Patent 602600. In cases when using this bleaching solution, it is preferred to intervene stop and washing steps between color developing and bleaching steps. In this case, the stop solution preferably contains an organic acid such as acetic acid, succinic acid or maleic acid; and the bleaching solution preferably contains 0.1 to 2 mol/l of an organic acid such as acetic acid, succinic acid, maleic acid, glutaric acid or adipinic acid to adjust the pH value or prevent bleach-fogging.

Photographic materials used in the invention may have a magnetic recording layer. The magnetic recording layer is preferably provided on the side opposite to the photographic component layers, in which a backing layer, antistatic layer (conductive layer), magnetic recording layer and lubricating layer are preferably coated in this order from the support.

As fine magnetic powder contained in the magnetic recording layer are employed magnetic metal powder, magnetic iron oxide powder, magnetic Co-doped iron oxide powder, magnetic chromium dioxide powder and magnetic barium ferrite powder. The magnetic powder can be prepared by the method known in the art. The optical density of the magnetic recording layer is preferably not more than 1.5, more preferably not more than 0.2, and still more preferably not more than 0.1, considering its influences on photographic images. The optical density can be measured using Densitometer PDA-65 (available from Konica Corp.), in which light of 436 nm is vertically incident through a blue filter to determine the absorption. The magnetic recording layer preferably has a magnetic susceptibility of $3\times10^{-2}$ emu or more per $m^2$ of photographic material. The magnetic susceptibility can be determined using sample-vibrating type magnetic flux meter VSM-3 (available from Toei Kogyo). Thus, after saturated with an external magnetic field of 1,000 Oe in the coating direction, the magnetic flux density (residual flux density) is measured at the time when the external magnetic field is reduced to zero, and the measured value is converted to the volume of the magnetic layer contained in $m^2$ of photographic material. The magnetic susceptibility of less than $3\times10^{-2}$ emu/$m^2$ mat cause troubles in magnetic recording input or output. The magnetic layer thickness is preferably 0.01 to 20 $\mu$m, more preferably 0.05 to 15 $\mu$m, and still more preferably 0.1 to 10 $\mu$m.

Preferred binders used in the magnetic recording layer include vinyl resin, cellulose ester rein, urethane resin, and polyester resin. It is preferred to form the binder by aqueous coating using an aqueous emulsion, without using an organic solvent. Physical properties can be adjusted by hardening with a hardener, thermally hardening or electron beam hardening. Specifically, the use of polyisocyanate type hardeners is preferred. It is necessary to incorporate abrasives into the magnetic recording layer to prevent clogging of a magnetic recording head. Non-magnetic metal oxide particles, specifically, fine alumina particles are preferably employed.

Supports of the photographic materials used in the invention include polyester film such as polyethylene terephthalate (PET) and polyethylene naphthalate (PEN); cellulose triacetate film, cellulose diacetate film; polycarbonate film; polystyrene film and polyolefin film. The use of high moisture content polyester, as set forth in JP-A 1-244446, 1-291248, 1-298350, 2-89045, 2-29641, 2-2-181749, 2-214852 and 2-291135 is superior in recovering roll-set curl after processing, even when the support is made thinner. Preferred supports used in the invention include PET and PEN films. The thickness thereof is preferably from 50 to 100 μm, and more preferably from 60 to 90 μm.

In one preferred embodiment of the invention, the photographic material has a conductive layer containing metal oxide particles, such as ZnO, $V_2O_5$, $TiO_2$, $SnO_2$, $Al_2O_3$, $In_2O_3$, $SiO_2$, MgO, BaO, and $MoO_3$. The preferred metal oxide particles are those which contain oxygen deficiency or which contain a small amount of a hetero atom capable of providing a donor to the metal oxide. Each of them is high in conductivity, and specifically, the later is preferred in terms of giving no fog. As binder used in the conductive layer or backing layer is employed the same one as used in the magnetic recording layer described above. Examples of the lubricating layer provided on the magnetic recording layer include higher fatty acid esters, higher fatty acid amides, olganosiloxanes, liquid paraffins and waxes.

In cases where the photographic materials according to the invention are employed as camera-speed color photographic roll films, the film width is preferably from ca. 20 to 35 mm, and more preferably ca. 20 to 30 mm, which is not only advantageous in compactness of cameras and patrones, but also leads to saving natural resources and spaces for storing processed negative films. The picture-taking area of from 300 to 700 $mm^2$ (preferably from 400 to 600 $mm^2$) achieves small format without deteriorating image qualities of final prints, leading to more compact patrones and cameras. The aspect ratio of the picture-taking area is not specifically limited, including 1:1 of the conventional 126 size, 1:1.4 of the half-size, 1:1.5 of the 135 size (standard), 1:1.8 of the high vision type and 1:3 of the panorama type.

The photographic materials used in the form of roll films are preferably contained in a cartridge. Typical cartridges include the patrone used in the 135 format. Other types of cartridges are also employed, as disclosed in Japanese Utility Model open to public inspection publication No. 58-67329 and 58-195236; JP-A 58-181035, 8-182634; U.S. Pat. No. 4,221,479, JP-A 1-231045, 2-170156, 2-199451, 2-124564, 2-201441, 2-205843, 2-210346, 2-211443, 2-214853, 2-264248, 3-37645 and 3-37646; U.S. Pat. Nos. 4,846,418, 4,848,693 and 4,832,275. These are also applicable to "compact photographic roll film patrone and film camera" disclosed in JP-A 5-210201.

EXAMPLES

The present invention will be further explained by referring to examples of the emulsion preparation, emulsions and photographic materials according to the invention, but the present invention is not limited to these examples.

Example 1

Preparation of seed emulsion T-1

Emulsion T-1 containing seed crystal grains having two parallel twin planes was prepared according to the following procedure.

| | |
|---|---|
| Solution A-1 | |
| Ossein gelatin | 38.0 g |
| Potassium bromide | 11.7 g |
| Water to make | 34.0 lit. |
| Solution B-1 | |
| Silver nitrate | 810.0 g |
| Water to make | 3815 ml |

-continued

| | |
|---|---|
| Solution C-1 | |
| Potassium bromide | 567.3 g |
| Water to make | 3815 ml |
| Solution D-1 | |
| Ossein gelatin | 163.4 g |
| 10 wt % compound A methanol solution | 5.5 ml |
| Water to make | 3961 ml |
| Compound A: $HO(CH_2CH_2O)_m[CH(CH_3)CH_2O]_{19.8}(CH_2CH_2O)_nH$ (m + n = 9.77) | |
| Solution E-1 | |
| Sulfuric acid (10%) | 91.1 ml |
| Solution F-1 | |
| 56% acetic acid aqueous solution, in a necessary amount | |
| Solution G-1 | |
| Ammonia water (28%) | 105.7 ml |
| Solution H-1 | |
| Potassium hydroxide aqueous solution (10%), in a necessary amount | |

Using a stirring apparatus described in JP-A 62-160128, solution E-1 was added to solution A-1 with vigorously stirring at 30° C. and then solutions B-1 and C-1, 279 ml of each were added by the double jet addition at a constant flow rate to form silver halide nucleus grains. Thereafter, solution D-1 was added, the temperature was raised to 60° C. in 31 min., solution G-1 was added, the pH was adjusted to 9.3 with solution H-1, and ripening was further conducted for 6.5 min. Then, the pH was adjusted to 5.8 with solution F-1 and the remaining solutions B-1 and C-1 were added by the double jet addition at an accelerated flow rate over a period of 37 min. and after competing the addition, the emulsion was immediately desalted according to the conventional procedure. The resulting seed emulsion was observed by an electron microscope and the emulsion was comprised monodisperse tabular grains having two parallel twin planes, equivalent circular diameter (ECD) of 0.72 μm and coefficient of variation of grain size distribution (COV) of 16%.

Preparation of emulsion Em-1 comprised of grains which have dislocation lines but do not have chloride-containing annular band Using the seed emulsion T-1 and the following solutions, emulsion Em-1 was prepared.

| | |
|---|---|
| Solution A-2 | |
| Ossein gelatin | 519.9 g |
| 10% compound A methanol solution | 5.5 ml |
| Seed emulsion T-1 | 5.3 mole equivalent equivalent |
| Water to make | 18.0 lit. |
| Solution B-2 | |
| 3.5N silver nitrate aqueous solution | 2787 ml |
| Solution C-2 | |
| Potassium bromide | 1020 g |
| Potassium iodide | 29.1 g |
| Water to make | 2500 ml |

-continued

| | |
|---|---|
| Solution D-2 | |
| Potassium bromide | 618.5 g |
| Potassium iodide | 8.7 g |
| Water to make | 1500 ml |
| Solution E-2 | |
| Potassium bromide | 208.3 g |
| Water to make | 1000 ml |
| Solution F-2 | |
| 56% acetic acid aqueous solution, in a necessary amount | |
| Solution H-2 | |

A fine grain emulsion of 0.672 mole equivalent, which was comprised of 3.0 wt % gelatin and fine silver iodide grains) ECD of 0.05 $\mu$m) was prepared in the following manner.

To 9942 ml of 5.0% gelatin aqueous solution containing 0.254 mol of potassium iodide were added 3092 ml aqueous solution containing 10.59 mol silver nitrate and 3092 ml aqueous solution containing 10.59 mol potassium iodide at a constant flow rate in 35 min. to form fine grains, while the temperature, were maintained at 40° C. and the pH and EAg were not specifically controlled.

| | |
|---|---|
| Solution I-2 | |
| Aqueous solution containing thiourea dioxide of $4 \times 10^{-6}$ mol/mol silver halide | 10 ml |
| Solution J-2 | |
| Aqueous solution containing sodium ethylthiosulfonate of $2.3 \times 10^{-5}$ mol/mol silver halide | 100 ml |
| Solution K-2 | |
| 10% Potassium hydroxide aqueous solution, in a necessary amount | |

To solution A-2 in a reaction vessel with vigorously stirring at 75° C. was added solution I-2, and then solutions B-2, C-2 and D-2 were added by the double jet addition according to Table 1 to grow the seed crystal grains to obtain comparative Emulsion Em-1. Taking account of the critical growth rate, the flow rates of solutions B-2, C-2 and D-2 acceleratedly varied according to functional equations so that no fine grains other than growing grains were formed and no deterioration in grain size distribution due to Ostwald ripening between grown grains occurred. In the first addition during the course of the grain growth, the temperature, pAg and pH in the reaction vessel was controlled to be 75° C., 8.9 and 5.8, respectively. Thus, 65.8% of solution B-2 was added in the first addition; then solution J-2 was added; the temperature in the reaction vessel was lowered to 40° C. in 30 min. and the pAg was adjusted to 10.3; and the total of solution H-2 was added at a given flow for 2 min., immediately followed by the second addition. In the second addition, the remainder of solution B-2 was added, while the temperature, pAg and pH were controlled at 40° C., 10.3 and 5.0, respectively. To control the pAg and pH, solutions E-2, F-2 and K-2 were optionally added.

TABLE 1

| Added solution | Time (min) | Added Amount, based on silver (%) | Iodide Content (mol %) | Addition order |
|---|---|---|---|---|
| B-2, C-2 | 0.00 | 0.0 | 2.0 | First Addition |
| | 5.26 | 11.7 | 2.0 | |
| | 8.63 | 21.2 | 2.0 | |
| | 12.65 | 34.8 | 2.0 | |
| | 15.81 | 47.3 | 2.0 | |
| | 19.85 | 65.8 | 2.0 | |
| B-2, D-2 | 0.00 | 65.8 | 1.0 | Second Addition |
| | 6.23 | 73.8 | 1.0 | |
| | 12.62 | 82.5 | 1.0 | |
| | 18.67 | 91.1 | 1.0 | |
| | 24.42 | 100.0 | 1.0 | |

After completing the grain formation, the emulsion was desalted according to the method described in JP-A 5-72658 and redispersed with adding gelatin to obtain an emulsion of a pAg of 8.06, a pH of 5.8 at 40° C. From electronmicroscopic observation of silver halide grains, it was proved that the emulsion was comprised of monodisperse, hexagonal tabular grains exhibiting ECD of 1.50 $\mu$m, COV of 14% and the mean aspect ratio of 7.0. Emulsion Em-2 was prepared in a manner similar to Em-1, provided that potassium iodide was further added in the same amount as in Em-5 described below to convert the surface bromide to the iodide.

Preparation of emulsions Em-3 to Em-5, each comprised of grains having an iodide containing annular band of 1%, based on the grain projected area.

Emulsions Em-3 to Em-5 each were prepared in a manner similar to Em-1, provided before desalting, a chloride containing annular band was formed according to the following procedure. Thus, when 98% of solution B-2 was added, the second addition was interrupted; the pAg was adjusted to 10.3 with solution E-2 and the addition continued with keeping the same pAg until 98% of solution B-2 was added; and then a small amount of solution B-2 was added to adjust the pAg to 9.0. NaCl was further added in a molar amount equivalent to the remainder of solution B-2, based on silver and the remainder of solution B-2 was added while the pAg was kept at 8.5 with solution E-2. At this moment, the chloride content in the annular band was 50 mol %, based on silver forming the annular band. Furthermore, 1N KI aqueous solution was added in an optimal amount to perform halide conversion at 50° C. over a period of 1 hr. The final chloride and iodide contents are shown in Table 2.

TABLE 2

| | Added iodide (mol %, based on chloride) | Iodide content of annular band* | Chloride content of annular band* |
|---|---|---|---|
| Em-3 | 0 | 0% | 50% |
| Em-4 | 50 | 25% | 25% |
| Em-5 | 100 | 50% | 0% |
| Em-4B | 50 | 25% | 25% |
| Em-4C | 50 | 25% | 25% |

*: mol %, based on silver forming the annular band

In Table 2, emulsion Em-4B was prepared in such a manner that during chemical sensitization of emulsion Em-3, as described below, halide conversion was performed by adding KI similarly to Em-4, after adding a sensitizing dye and before adding a chemical sensitizer. Similarly, emulsion Em-4C was prepared through halide conversion by adding KI at 1 min. after adding the chemical sensitizer.

Emulsion Em-6 comprising grains having iodide-containing band of 1%, based the projected area, was prepared according to the following procedure. Thus, in the formation of the chloride-containing annular band of Em-3, instead of adding NaCl in a molar amount equivalent to the remainder of solution B-2, based on silver, KI of 25 mol %, based on silver was added and the remainder of solution B-2 was added while the pAg was kept at 9.0 with solution E-2. Prepared emulsion Em-6 was comprised of grains having an annular band containing mean 25 mol % iodide and accounting for 1% of the projected area of the major face.

Emulsion Em-7 comprising grains having an annular band containing iodide and accounting for 15% of the projected area, was prepared according to the following procedure. Thus, in the preparation of Em-1, a chloride-containing annular band was formed prior to desalting, as follows. To the solution E-2 used in the preparation of Em-1, 5.11 g of NaCl was added, and the remainder of solution B-2 was added, while the pAg was controlled at 8.5. The resulting emulsion was comprised of tabular grains of 1.42 $\mu$m ECD, in which the chloride content in the annular band was 1 mol %, based on silver. Further, halide conversion was performed by adding KI in an amount corresponding 50 mol % of the chloride to obtain emulsion Em-7 comprised of grains having iodide-containing annular band, which accounted for 15% of the projected area.

Preparation of Chemically Sensitized Emulsion

Emulsions Em-1, Em-2, Em-3, Em-4, Em-5, Em-6 and Em-7 each were fractionated into the volume containing 1 mole silver halide. To each fraction were added sensitizing dyes in the 9th layer, then, 60 mg of KSCN, optimal amounts of a sulfur sensitizer (sodium thiosulfate) and a gold sensitizer (chloroauric acid) were further added, and the mixture was raised to a temperature of 50° C. and reacted over an appropriate period of time. Furthermore, 11.44 mg/mol Ag of 1-(3-acetoamidophenyl)-5-mercaptotetrazole (APMT) and an optimal amount of selenium sensitizer (triphenylphosphine selenide) were added thereto and the mixture was reacted. After completing the reaction, the reaction mixture was cooled to 40° C., while 114.4 mg of APMT was added. The resulting emulsions were denoted as Em-1A, Em-2A, Em-3A, Em-4A, Em-5A, Em-6A and Em-7A.

Preparation of Color Photographic Material

The following layers having the composition described below were coated on a subbed cellulose triacetate film support in this order from the support to prepare a multi-layered color photographic material Samples 11 to 19. Silver iodobromide emulsions used in the layers other than the 9th layer were those which each were optimally chemically sensitized by adding sensitizing dyes and then further adding triphenylphosphine selenide, sodium thiosulfate, chloroauric acid and potassium thiocyanate, according to the conventional manner.

In the following examples, the addition amount in the silver halide photographic material was expressed in g per $m^2$, unless otherwise noted. The coating amount of silver halide or colloidal silver was converted to silver. With respect to a sensitizing dye, it was expressed in mol per mol of silver halide contained in the same layer.

| 1st Layer; Antihalation Layer | |
|---|---|
| Black colloidal silver | 0.16 |
| UV absorbent (UV-1) | 0.20 |
| High boiling solvent (Oil-1) | 0.16 |
| Gelatin | 1.23 |

-continued

| 2nd Layer; Interlayer | |
|---|---|
| Compound (SC-1) | 0.15 |
| High boiling solvent (Oil-2) | 0.17 |
| Gelatin | 1.27 |
| **3rd layer; Low speed red-sensitive layer** | |
| Silver iodobromide emulsion (ECD = 0.38 $\mu$m, 8.0 mol % iodide) | 0.50 |
| Silver iodobromide emulsion (ECD = 0.27 $\mu$m, 2.0 mol % iodide) | 0.21 |
| Sensitizing dye (SD-1) | $2.6 \times 10^{-5}$ |
| Sensitizing dye (SD-2) | $2.6 \times 10^{-5}$ |
| Sensitizing dye (SD-3) | $3.1 \times 10^{-4}$ |
| Sensitizing dye (SD-4) | $2.3 \times 10^{-5}$ |
| Sensitizing dye (SD-5) | $2.8 \times 10^{-4}$ |
| Cyan coupler (C-1) | 0.35 |
| Colored cyan coupler (CC-1) | 0.065 |
| Compound (GA-1) | $2.0 \times 10^{-3}$ |
| High boiling solvent (Oil-1) | 0.33 |
| Gelatin | 0.73 |
| **4th Layer; Medium Speed Red-sensitive Layer** | |
| Silver iodobromide emulsion (ECD = 0.52 $\mu$m, 8.0 mol % iodide) | 0.62 |
| Silver iodobromide emulsion (ECD = 0.38 $\mu$m, 8.0 mol % iodide) | 0.27 |
| Sensitizing dye (SD-1) | $1.3 \times 10^{-4}$ |
| Sensitizing dye (SD-2) | $1.3 \times 10^{-4}$ |
| Sensitizing dye (SD-3) | $2.5 \times 10^{-4}$ |
| Sensitizing dye (SD-4) | $1.8 \times 10^{-5}$ |
| Cyan coupler (C-1) | 0.24 |
| Colored cyan coupler (CC-1) | 0.040 |
| DIR compound (D-1) | 0.025 |
| Compound (GA-1) | $1.0 \times 10^{-3}$ |
| High boiling solvent (Oil-1) | 0.30 |
| Gelatin | 0.59 |
| **5th Layer; High Speed Red-sensitive Layer** | |
| Silver iodobromide emulsion G (ECD = 1.0 $\mu$m, 8.0 mol % iodide) | 1.27 |
| Sensitizing dye (SD-1) | $8.5 \times 10^{-5}$ |
| Sensitizing dye (SD-2) | $9.1 \times 10^{-5}$ |
| Sensitizing dye (SD-3) | $1.7 \times 10^{-4}$ |
| Sensitizing dye (SD-4) | $2.3 \times 10^{-5}$ |
| Cyan coupler (C-2) | 0.10 |
| Colored cyan coupler (CC-1) | 0.014 |
| DIR compound (D-1) | $7.5 \times 10^{-3}$ |
| Compound (GA-1) | $1.4 \times 10^{-3}$ |
| High boiling solvent (Oil-1) | 0.12 |
| Gelatin | 0.53 |
| **6th Layer; Interlayer** | |
| Compound (SC-1) | 0.09 |
| High boiling solvent (Oil-2) | 0.11 |
| Gelatin | 0.80 |
| **7th Layer; Low Speed Green-sensitive Layer** | |
| Silver iodobromide emulsion (ECD = 0.38 $\mu$m, 8.0 mol % iodide) | 0.61 |
| Silver iodobromide emulsion (ECD = 0.27 $\mu$m, 2.0 mol% iodide) | 0.20 |
| Sensitizing dye (SD-7) | $5.5 \times 10^{-4}$ |
| Sensitizing dye (SD-1) | $5.2 \times 10^{-5}$ |
| Sensitizing dye (SD-12) | $4.8 \times 10^{-5}$ |
| Magenta coupler (M-1) | 0.15 |
| Magenta coupler (M-2) | 0.37 |
| Colored magenta coupler (CM-1) | 0.20 |
| DIR compound (D-2) | 0.020 |
| Compound (GA-1) | $4.0 \times 10^{-3}$ |
| High boiling solvent (Oil-2) | 0.65 |
| Gelatin | 1.65 |
| **8th Layer; Medium Speed Green-sensitive Layer** | |
| Silver iodobromide emulsion E (ECD = 0.59 $\mu$m, 8.0 mol % iodide) | 0.87 |
| Sensitizing dye (SD-7) | $2.4 \times 10^{-4}$ |
| Sensitizing dye (SD-8) | $2.4 \times 10^{-4}$ |
| Magenta coupler (M-1) | 0.058 |

-continued

| | |
|---|---|
| Magenta coupler (M-2) | 0.13 |
| DIR compound (D-2) | 0.025 |
| DIR compound (D-3) | 0.025 |
| High boiling solvent (Oil-2) | 0.50 |
| Gelatin | 1.00 |
| 9th Layer; High Speed Green-sensitive Layer | |
| Silver iodobromide emulsion (Table 3) | 1.27 |
| Sensitizing dye (SD-8) | $1.4 \times 10^{-4}$ |
| Sensitizing dye (SD-9) | $1.5 \times 10^{-4}$ |
| Sensitizing dye (SD-10) | $1.4 \times 10^{-4}$ |
| Sensitizing dye (SD-12) | $7.1 \times 10^{-5}$ |
| Magenta coupler (M-2) | 0.065 |
| Magenta coupler (M-3) | 0.025 |
| Colored magenta coupler (CM-2) | 0.025 |
| DIR compound (D-3) | $7.0 \times 10^{-4}$ |
| Compound (GA-1) | $1.8 \times 10^{-3}$ |
| High boiling solvent (Oil-2) | 0.15 |
| Gelatin | 0.46 |
| 10th Layer; Yellow Filter Layer | |
| Yellow colloidal silver | 0.08 |
| Compound (SC-1) | 0.15 |
| Formaline scavenger (FS-1) | 0.20 |
| High boiling solvent (Oil-2) | 0.19 |
| Gelatin | 1.10 |
| 11th Layer; Interlayer | |
| Formaline scavenger (FS-1) | 0.20 |
| Gelatin | 0.60 |
| 12th Layer; Low Speed Blue-sensitive Layer | |
| Silver iodobromide emulsion (ECD = 0.38 $\mu$m, 8.0 mol % iodide) | 0.22 |
| Silver iodobromide emulsion (ECD = 0.27 $\mu$m, 2.0 mol % iodide) | 0.10 |
| Sensitizing dye (SD-11) | $5.4 \times 10^{-4}$ |
| Sensitizing dye (SD-12) | $2.0 \times 10^{-4}$ |
| Yellow coupler (Y-1) | 0.62 |
| Yellow coupler (Y-2) | 0.31 |
| Compound (GA-1) | $4.5 \times 10^{-3}$ |
| High boiling solvent (Oil-2) | 0.20 |
| Gelatin | 1.27 |
| 13th Layer; Medium Speed Blue-sensitive Layer | |
| Silver iodobromide emulsion (ECD = 0.59 $\mu$m, 8.0 mol % iodide) | 0.90 |
| Sensitizing dye (SD-11) | $3.2 \times 10^{-4}$ |
| Sensitizing dye (SD-12) | $3.2 \times 10^{-4}$ |
| Yellow coupler (Y-1) | 0.15 |

-continued

| | |
|---|---|
| DIR compound ((D-1) | 0.010 |
| High boiling solvent (Oil-2) | 0.046 |
| Gelatin | 0.47 |
| 14th Layer; High Speed Blue-sensitive Layer | |
| Silver iodobromide emulsion (ECD = 1.00 $\mu$m, 8.0 mol % iodide) | 0.85 |
| Sensitizing dye (SD-11) | $3.2 \times 10^{-4}$ |
| Sensitizing dye (SD-12) | $3.2 \times 10^{-4}$ |
| Yellow coupler (Y-1) | 0.11 |
| High boiling solvent (Oil-2) | 0.046 |
| Gelatin | 0.47 |
| 15th Layer; First Protective Layer | |
| Silver iodobromide emulsion (ECD = 0.08 $\mu$m, 1.0 mol % iodide) | 0.40 |
| UV absorbent (UV-2) | 0.030 |
| UV absorbent (UV-3) | 0.015 |
| UV absorbent (UV-4) | 0.015 |
| UV absorbent (UV-5) | 0.015 |
| UV absorbent (UV-6) | 0.10 |
| Formaline scavenger (FS-1) | 0.25 |
| High boiling solvent (Oil-1) | 0.07 |
| High boiling solvent (Oil-3) | 0.07 |
| Gelatin | 1.04 |
| 16th Layer; Second Protective Layer | |
| Polico (methylmethacrylate/ethylmethacrylate/methacrylic acid) | 0.15 |
| Polymethylmethacrylate (Av. 3 $\mu$m) | 0.04 |
| Lubricant (WAX-1) | 0.04 |
| Fluorinated surfactant (F-1) | 0.01 |
| Fluorinated surfactant (F-2) | 0.01 |
| Gelatin | 0.55 |

In addition to the above composition were added coating aid compounds SU-1 and SU-2, hardeners H-1 and H-2, dyes AI-1, AI-2 and AI-3, stabilizer ST-1, fog restrainer AF-1, AF-2 and AF-3 comprising two kinds of weight-averaged molecular weights of 10,000, and antimold DI-1. Gelatins containing a calcium content of 10 ppm or less were used.

Chemical structures of compounds described above are as follows.

C-1

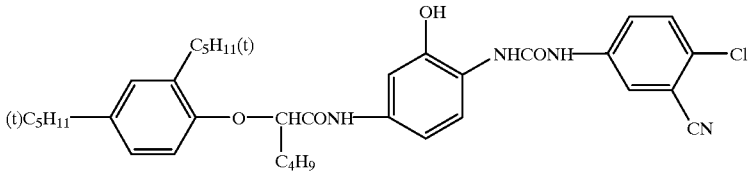

C-2

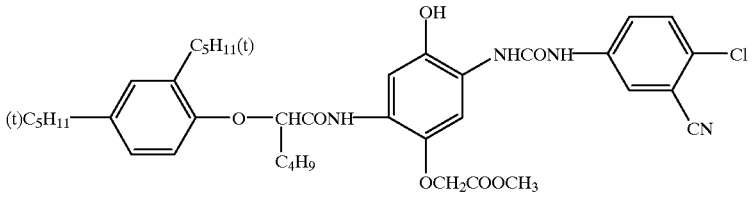

-continued
M-1
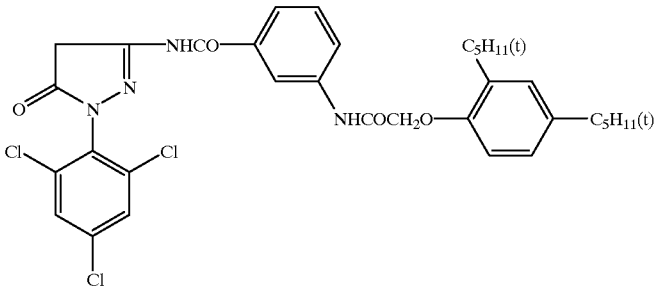
M-2
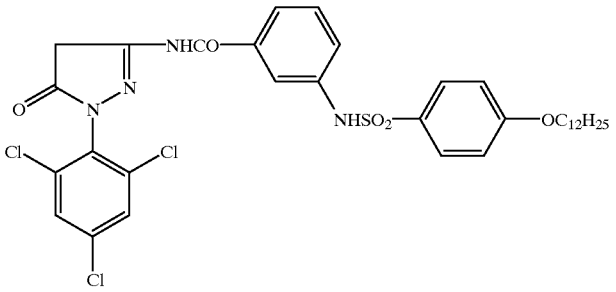
M-3
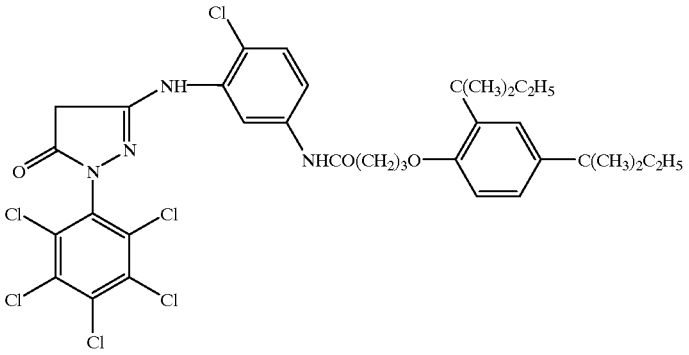
Y-1
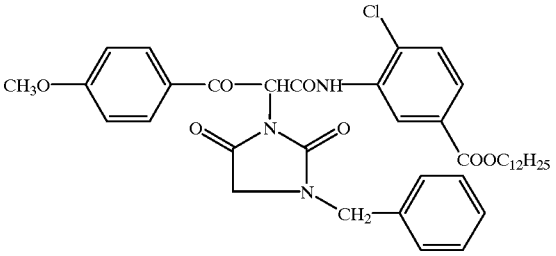
Y-2
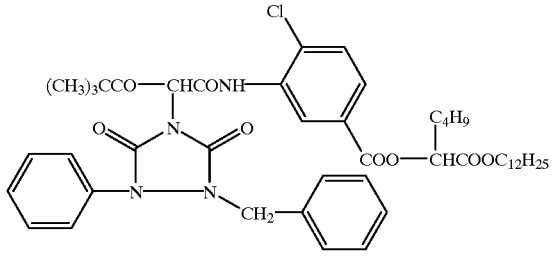

-continued
CC-1
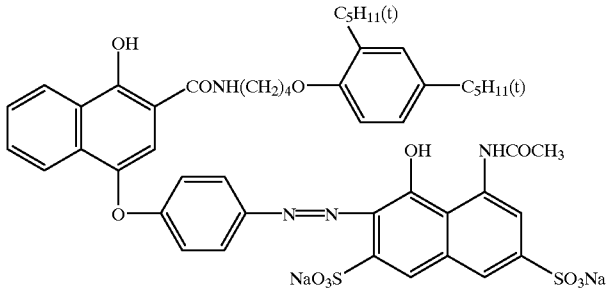
CM-1
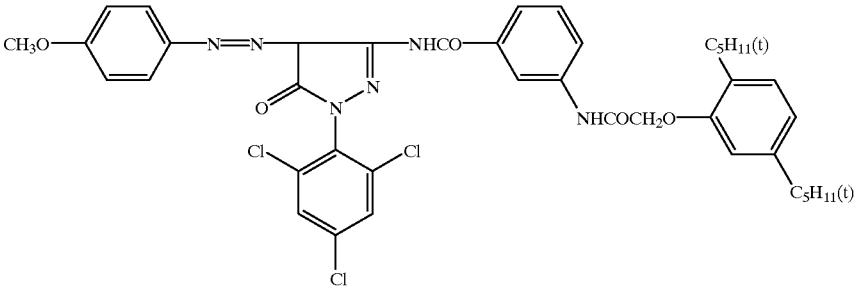
CM-2
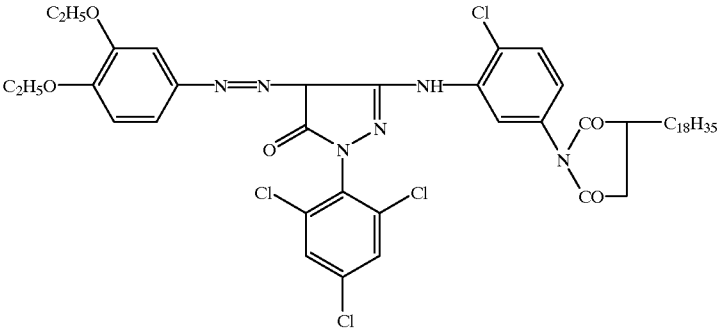
D-1
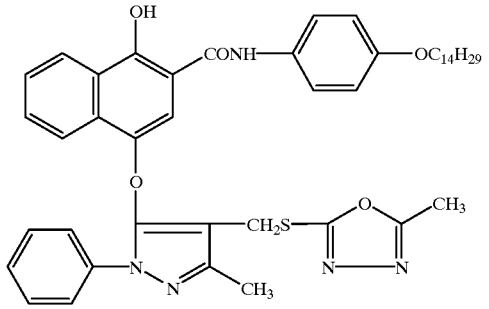

-continued
D-2
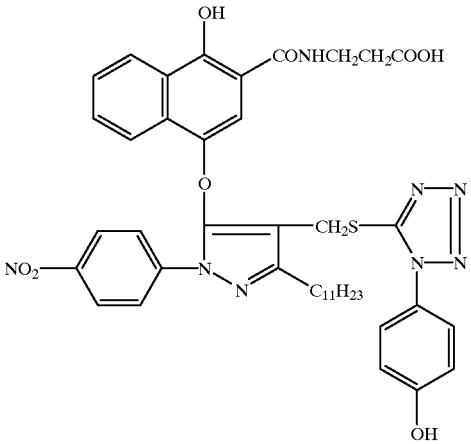
D-3
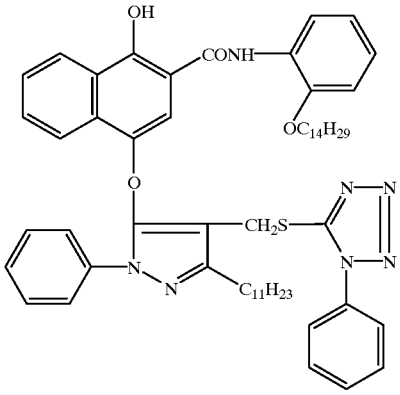
Oil-1
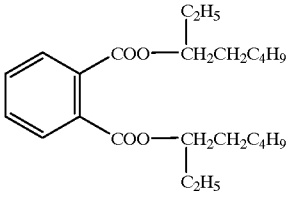
Oil-2
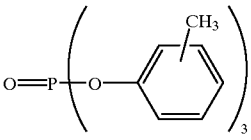
Oil-3
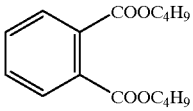
GA-1
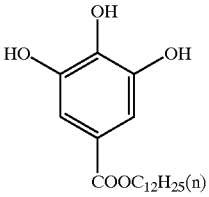
SC-1
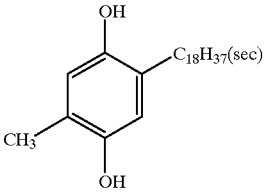
FS-1
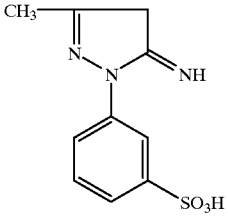

-continued
UV absorbent
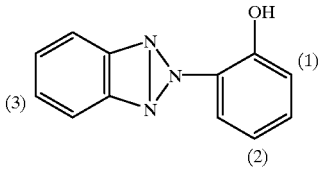
| | (1) | (2) | (3) |
|---|---|---|---|
| UV-1 | $C_{12}H_{25}$ | $CH_3$ | H |
| UV-2 | H | (t)$C_4H_9$ | H |
| UV-3 | (t)$C_4H_9$ | (t)$C_4H_9$ | H |
| UV-4 | (t)$C_4H_9$ | $CH_3$ | Cl |
| UV-5 | (t)$C_4H_9$ | (t)$C_4H_9$ | Cl |
UV-6
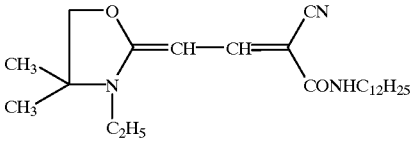
SD-1
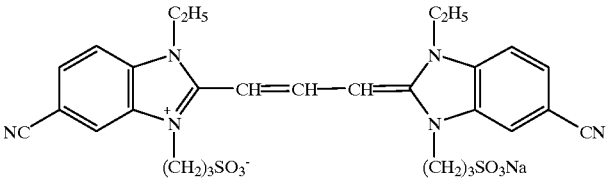
SD-2
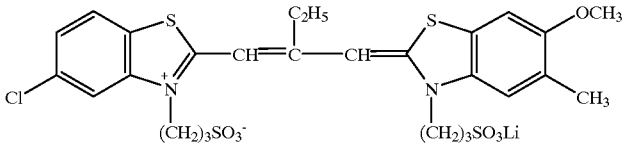
SD-3
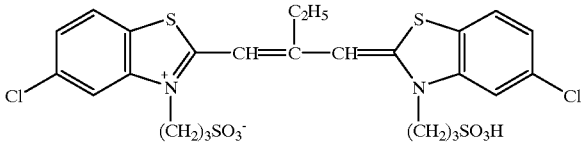
SD-4
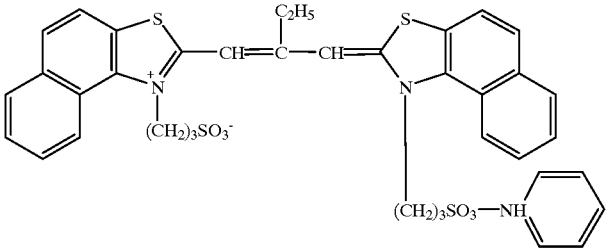
SD-5
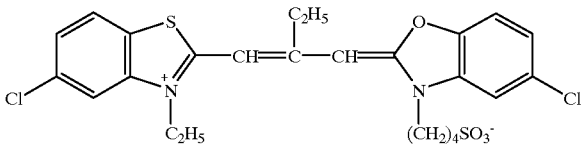

-continued
SD-7
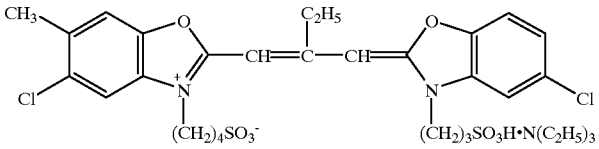
SD-8
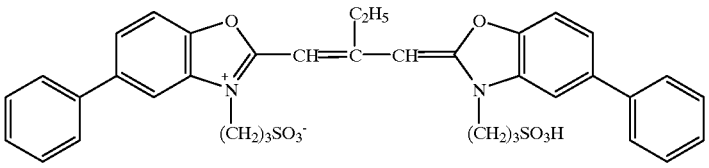
SD-9
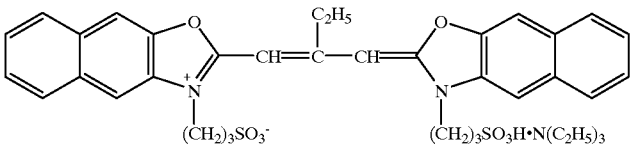
SD-10
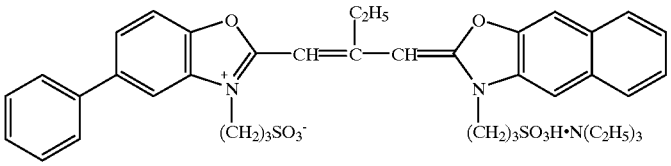
SD-11
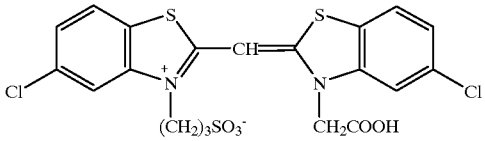
SD-12
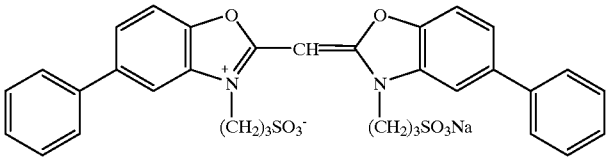
Al-1
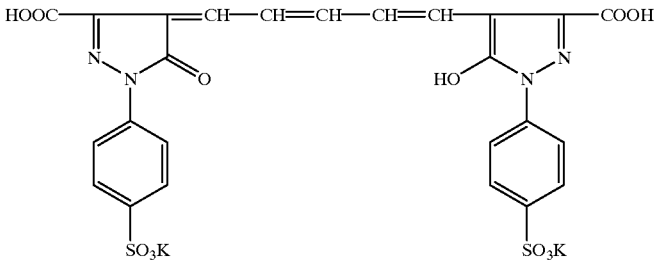

-continued

Al-2

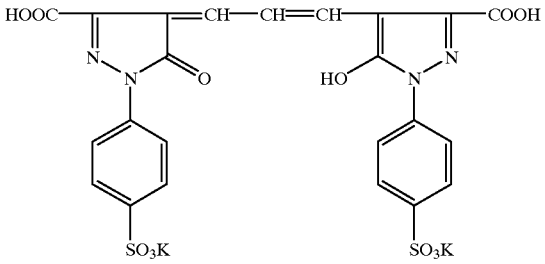

WAX-1

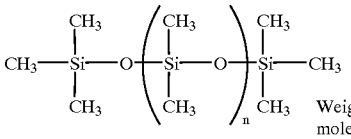

Weight-averaged mean molecular weight Mw = 3,000

F-1

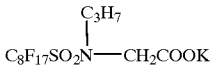

F-2

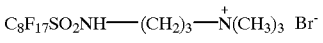

SU-1

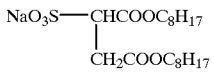

SU-2

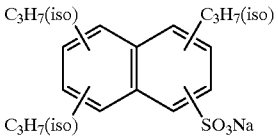

ST-1

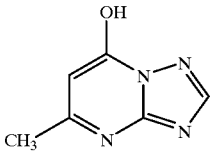

AF-1

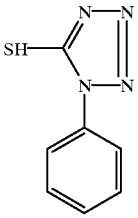

AF-2

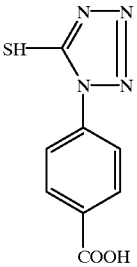

AF-3

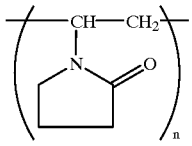

n: Degree of polymerization

DI-1

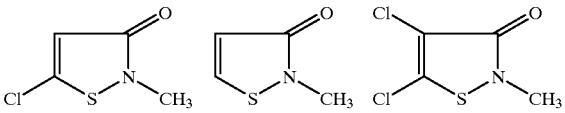

A B C

A:B:C = 50:46:4 (molar ratio)

H-1

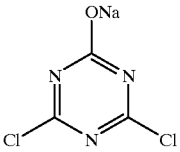

H-2

$(CH_2{=}CHSO_2CH_2)_2O$

Samples each were sensitometrically exposed to green light, then allowed to stand under the condition A described below, processed according to the following steps and evaluated with respect to sensitivity and fog.

Condition A: over a period of 7 days at 50° C. and 80% R.H. Processing step (38° C.):

| | |
|---|---|
| Color developing | 3 min. 15 sec. |
| Bleach | 6 min. 30 sec. |
| Washing | 3 min. 15 sec. |
| Fixing | 6 min. 30 sec. |

-continued

| | |
|---|---|
| Washing | 3 min. 15 sec. |
| Stabilizing | 1 min. 30 sec. |
| Drying | |

Composition of a processing solution used in each step is as follows.

| | |
|---|---|
| Color developing solution | |
| 4-Amino-3-methyl-N-ethyl-N-(β-hydroxy ethyl) aniline sulfate | 4.75 g |
| Sodium sulfite anhydride | 4.25 g |
| Hydroxylamine ½ sulfate | 2.0 g |
| Potassium carbonate anhydride | 37.5 g |
| Sodium bromide | 1.30 g |
| Trisodium nitrilotriacetate (monohydrate) | 2.50 g |
| Potassium hydroxide | 1.00 g |
| Water to make | 1 liter |
| The pH was adjusted to 10.1. | |
| Bleaching solution | |
| Ammonium ferric ethylenediaminetetraacetate | 100.0 g |
| Diammonium ethylenediaminetetraacetate | 10.0 g |
| Ammonium bromide | 150.0 g |
| Glacial acetic acid | 10.0 g |
| Water to make | 1 liter |
| The pH was adjusted to 6.0 using ammonia water. | |
| Fixing solution | |
| Ammonium thiosulfate | 175.0 g |
| Sodium sulfite anhydride | 8.5 g |
| Sodium metasulfite | 2.3 g |
| Water to make | 1 liter |
| The pH was adjusted to 6.0 with acetic acid. | |
| Stabilizing solution | |
| Formalin (37% aqueous solution) | 1.5 cc |
| Koniducks (product by Konica Corp.) | 7.5 cc |
| Water to make | 1 liter |

Fog density is represented by a relative value, based on the fog density of Sample 11 which was processed immediately after exposure, being 100. Sensitivity (denoted as "S") is represented by reciprocal of exposure necessary to give a density of fog density plus 0.1 and also represented by a relative value, based on the sensitivity of Sample 11 which was processed immediately after exposure, being 100.

Results are shown in Table 3 with respect to the sensitivity and fog of samples which were processed immediately after exposure (denoted before storage) or after exposed and stored under the condition A (denoted as after storage).

TABLE 3

| | Before Storage | | After Storage | | |
|---|---|---|---|---|---|
| Sample No. | S | Fog | S | Fog | Remark |
| No. 11 (Em-1A) | 100 | 100 | 80 | 110 | Comp. |
| No. 12 (Em-2A) | 90 | 90 | 85 | 90 | Comp. |
| No. 13 (Em-3A) | 110 | 100 | 100 | 110 | Comp. |
| No. 14 (Em-4A) | 140 | 90 | 130 | 95 | Inv. |
| No. 15 (Em-5A) | 130 | 80 | 125 | 80 | Inv. |
| No. 16 (Em-4B) | 150 | 90 | 140 | 95 | Inv. |
| No. 17 (Em-4C) | 160 | 90 | 150 | 90 | Inv. |

TABLE 3-continued

| | Before Storage | | After Storage | | |
|---|---|---|---|---|---|
| Sample No. | S | Fog | S | Fog | Remark |
| No. 18 (Em-6A) | 110 | 70 | 110 | 70 | Inv. |
| No. 19 (Em-7A) | 90 | 70 | 90 | 80 | Comp. |

As apparent from Table 3, inventive samples were superior in sensitivity and fog to comparative samples. It was further proved that the use of tabular grains according to the invention, which contained dislocation lines, also led to superior results.

What is claimed is:

1. A silver halide emulsion comprising tabular silver halide grains, wherein said tabular grains contain 50 mol % or more bromide, based on total silver and have parallel (111) major faces and a mean aspect ratio of not less than 2; and the tabular grains each comprising a central region accounting for at least 50% of the (111) major face, and an annular band accounting for not more than 5% of the (111) major face and containing not less than 0.05 mol % iodide and not more than 50 mol % chloride, based on silver forming the annular band.

2. The silver halide emulsion of claim 1, wherein said annular band contains not less than 0.5 mol % chloride.

3. The silver halide emulsion of claim 1, wherein said tabular grains are in a hexagonal form, and said central region having dislocation lines.

4. A method of preparing a silver halide emulsion comprising tabular grains, wherein said tabular grains contain 50 mol % or more bromide, based on total silver and have parallel (111) major faces and a mean aspect ratio of not less than 2; and the tabular grains each comprising a central region accounting for at least 50% of the (111) major face, and an annular band accounting for not more than 5% of the (111) major face and containing not less than 0.05 mol % iodide and not more than 50 mol % chloride, based on silver forming the annular band, the method comprising the steps of:

(a) reacting silver and a halide salts in solution to form tabular grains substantially not containing chloride, (b) reacting a silver salt solution and a chloride containing halide salt solution to form the annular band containing chloride and (c) adding a water soluble iodide salt to perform conversion of at least a part of the chloride to iodide.

5. The method of claim 4, wherein in step (c), the iodide is added in an amount of 100 mol % or less, based on the chloride contained in the annular band.

6. The method of claim 4, wherein in step (c), the conversion is performed in the presence of a sensitizing dye.

7. The method of claim 4, wherein in step (c), the conversion is performed in the presence of a chemical sensitizer.

8. The method of claim 4, wherein the tabular grains formed in step (a) are in a hexagonal form.

9. The method of claim 4, wherein dislocation lines are introduced during step (a).

* * * * *